US008851061B2

(12) United States Patent
Johnson

(10) Patent No.: US 8,851,061 B2
(45) Date of Patent: Oct. 7, 2014

(54) OVEN WITH AMBIENT AIR COOLING

(75) Inventor: Eric Scott Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 4 days.

(21) Appl. No.: 13/431,162

(22) Filed: Mar. 27, 2012

(65) Prior Publication Data

US 2013/0255655 A1 Oct. 3, 2013

(51) Int. Cl.
*A24B 5/00* (2006.01)

(52) U.S. Cl.
USPC ..... 126/15 A; 126/21 A; 126/21 R; 219/757

(58) Field of Classification Search
USPC ..... 126/21 R, 21 A, 15 A; 219/757
See application file for complete search history.

(56) References Cited

U.S. PATENT DOCUMENTS

| | | | | |
|---|---|---|---|---|
| 5,986,248 | A | 11/1999 | Matsuno et al. | |
| 6,657,167 | B2 | 12/2003 | Loveless | |
| 6,880,544 | B2 * | 4/2005 | Hegge et al. | 126/20 |
| 2004/0245247 | A1 * | 12/2004 | Rawal | 219/757 |
| 2011/0276184 | A1 * | 11/2011 | McKee et al. | 700/276 |
| 2013/0036918 | A1 * | 2/2013 | Sakane | 99/358 |

FOREIGN PATENT DOCUMENTS

JP 2000-48947 A * 2/2000 ..... H05B 6/74

* cited by examiner

*Primary Examiner* — Kenneth Rinehart
*Assistant Examiner* — Gajanan M Prabhu
(74) *Attorney, Agent, or Firm* — Global Patent Operation; Douglas D. Zhang

(57) ABSTRACT

An oven is described having an interior space defined by a plurality of side walls, a duct, and a blower. The duct is in fluid communication with a ventilation aperture in at least one of the side walls and a supply of ambient air external to the oven cavity. The blower is in fluid communication with the duct and forces the supply of ambient air into the oven cavity via the ventilation aperture.

22 Claims, 7 Drawing Sheets

OVEN WITH AMBIENT AIR COOLING

BACKGROUND

The present disclosure generally relates to cooking appliances, and more particularly to ovens.

Food in most ovens is cooked with a combination of both radiant and convection heat. All sides of oven-cooked food are exposed to a hot environment. This provides cooking in both an axial direction (top-to-bottom) and a radial direction (from the sides inward). Because heat provided to the center of the food must be conducted through the sides, the sides of food tend to heat faster than the center, which generally results in the formation of a crust along the sides and an uneven final texture of the food, or "doneness." Examples of such uneven final textures include overcooked or hard edges on brownies and domed rising on cakes. While this may be desirable for some consumers, others may prefer more uniform cooking.

Accordingly, it would be desirable to provide a cooking system that overcomes at least some of the problems identified above.

BRIEF DESCRIPTION OF THE INVENTION

As described herein, the exemplary embodiments overcome one or more of the above or other disadvantages known in the art.

One aspect of the exemplary embodiments relates to an oven having an interior space defined by a plurality of side walls, a duct, and a blower. The duct is in fluid communication with a ventilation aperture in at least one of the side walls and a supply of ambient air external to the oven. The blower is in fluid communication with the duct and forces the supply of ambient air into the oven via the ventilation aperture.

Another aspect of the exemplary embodiments relates to an oven having an interior space defined by a plurality of walls, a circulation fan, a duct, and a damper. The duct is in fluid communication with a ventilation aperture in at least one of the walls and a supply of ambient air external to the oven cavity. The circulation fan circulates air throughout the oven cavity via the ventilation aperture. The damper is disposed between the supply of ambient air and the ventilation aperture and modulates an amount of air drawn in to the interior space.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE DISCLOSURE

Figure 1:
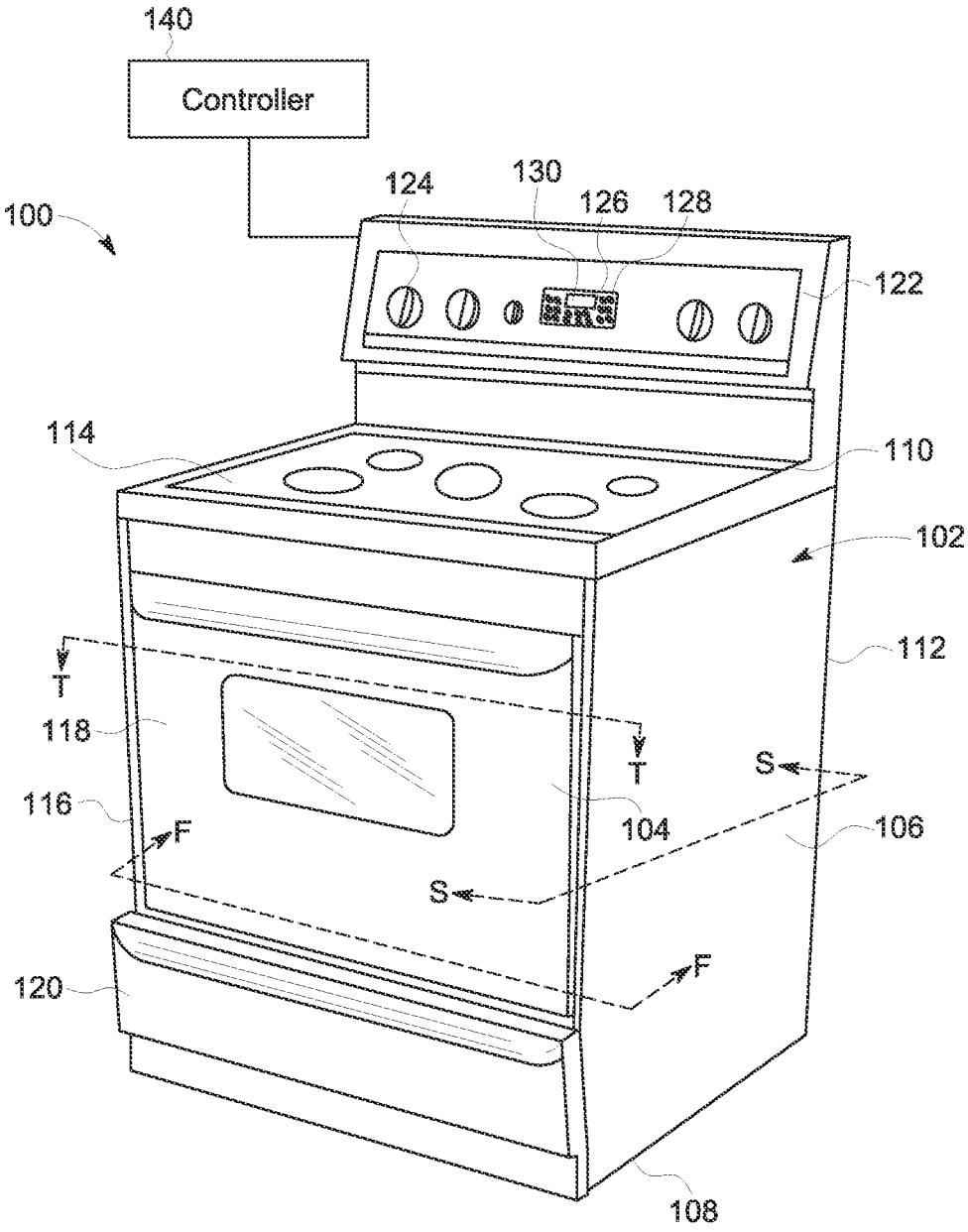
FIG. 1 is a perspective view of an exemplary range including an oven incorporating aspects of the disclosed embodiments.

Referring to FIG. 1, an exemplary appliance such as a freestanding range in accordance with aspects of the disclosed embodiments is generally designated by reference numeral 100. The aspects of the disclosed embodiments are generally directed to cooling, or limiting the heating of the sides of oven-baked goods to promote more even cooking and rising. Although a range 100 is shown in FIG. 1, the aspects of the disclosed embodiments can be applied to any oven style heating or cooking appliance.

As is shown in FIG. 1, the range 100 includes a cabinet or housing 102 that has a front portion 104, opposing side panels 106, a base or bottom portion 108, a top portion 110, and a back panel 112. In the embodiment shown in FIG. 1, the top portion 110 of the range 100 includes a cooktop 114. In alternate embodiments, the range 100 does not include a cooktop 114, such as in the case of a wall oven.

The range 100 also includes an oven unit 116. Although the aspects of the disclosed embodiments are described herein with respect to the single oven configuration shown in FIG. 1, in alternate embodiments, the range 100 could comprise a multiple oven unit. The range 100 includes an oven door 118 and a pullout drawer 120, the operation of which is generally understood.

In one embodiment, the cabinet 102 of the range 100 includes a control area 122 that supports one or more controls, generally referred to herein as burner controls 124. The burner control or control knob 124 shown in FIG. 1 is generally in the form of a knob style control that extends outwardly from and can be supported by the control area 122, which in one embodiment comprises a backsplash. In one embodiment, a control panel 126 includes a plurality of input selectors or switches 128 and a display 130 cooperating with control knob 124 to form a user interface for selecting and displaying cooking cycles, warming cycles and/or other operating features, including enabling an "even-rise" operational mode of the oven unit 116 to limit side-heating of oven cooked foods. In one embodiment, the input selectors or controls 128 can be in the form of push buttons or electronic switches.

In one embodiment, the oven 100 includes a controller 140. The controller 140 is coupled to, or integrated within, the control panel 126 and configured to receive inputs and commands from, for example, the controls 124, 128, and controls the various operations and functions of the oven 100. In one embodiment, the controller 140 can include or comprise an electronic range control, and can be used to activate and control the "even-rise" operational mode of the oven unit 116 to direct cool ambient air to the sides of an item being cooked in the oven, as is further described herein.

Figure 2:
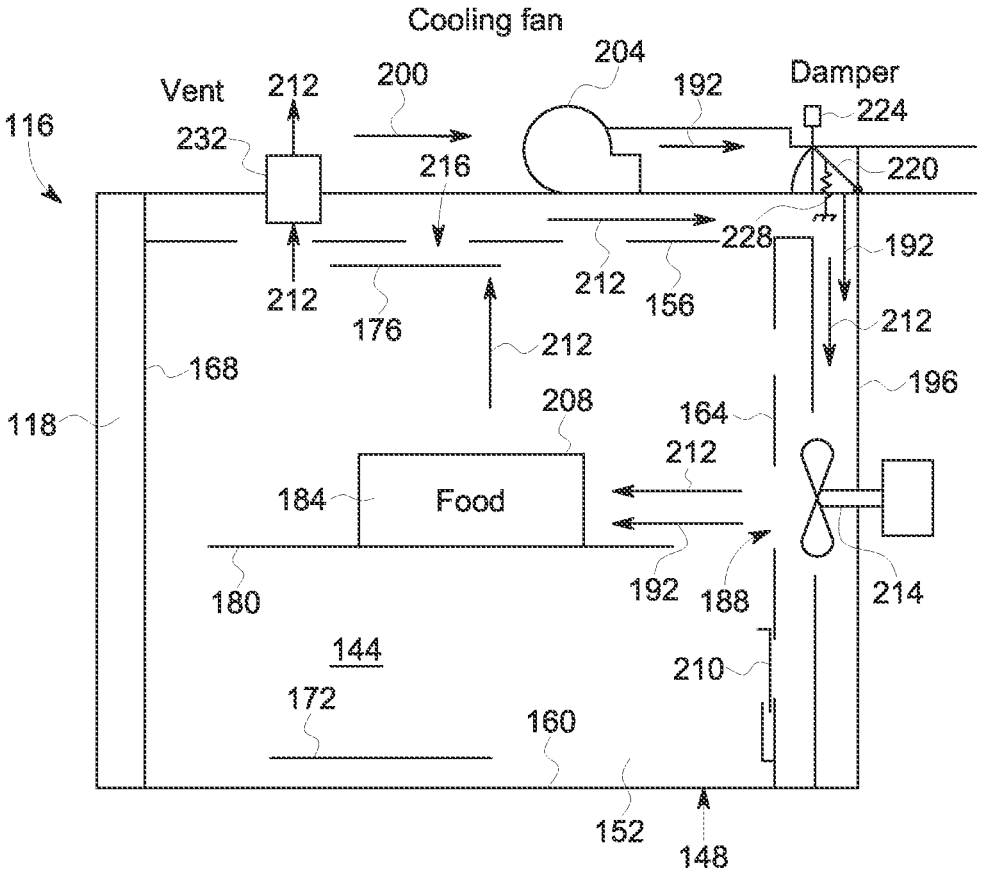
FIGS. 2 is a schematic cross-sectional view of the range illustrated in FIG. 1 along the line S-S.
Figure 3:
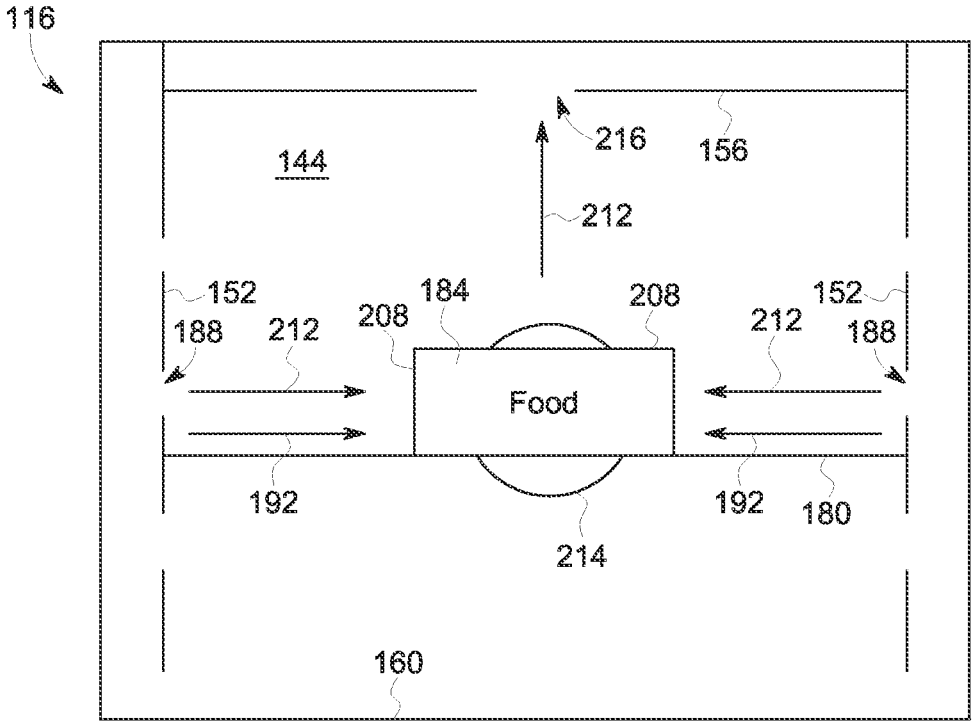
FIG. 3 is a schematic cross-sectional view of the range illustrated in FIG. 1 along the line F-F.
Figure 4:
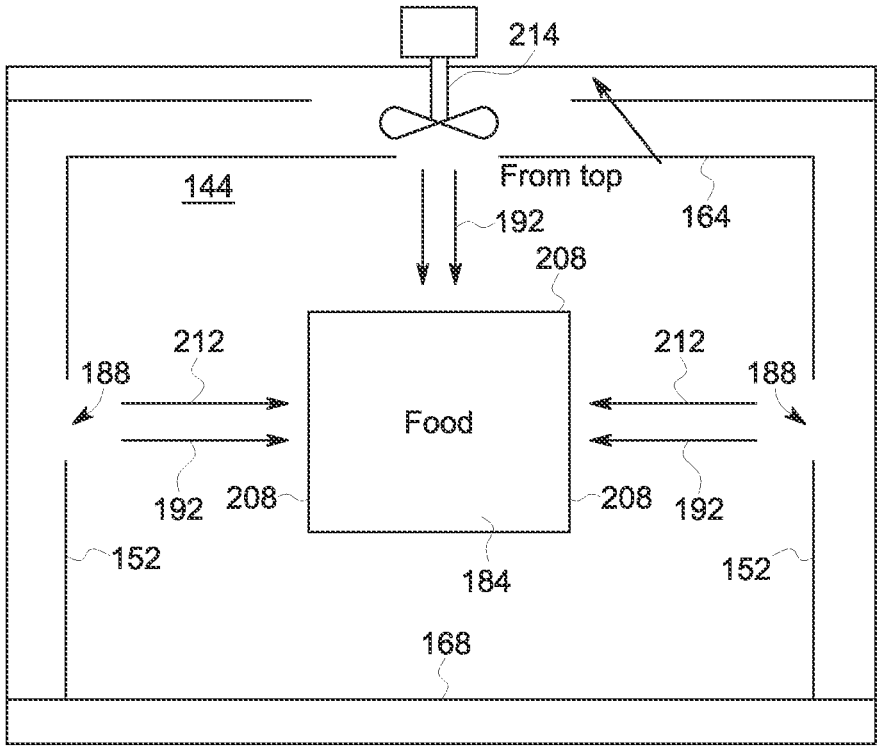
FIG. 4 is a schematic cross-sectional view of the range illustrated in FIG. 1 along the line T-T.

FIGS. 2, 3 and 4 are schematic cross-sectional side, front, and top views, respectively, of the oven unit 116 shown in FIG. 1. Referring to FIGS. 2, 3, and 4 together, positioned within the oven unit 116, which is supported by the cabinet shown in FIG. 1, is a cooking chamber or oven cavity 144 (also herein referred to as an "oven interior space"). The oven cavity 144 is formed, or defined, by a box-like wall or oven liner 148. The oven liner 148 includes a plurality of inner walls, such as vertical side walls 152, a top wall 156, a bottom wall 160, a rear wall 164, and an inner door wall 168.

The oven cavity 144 is provided with a lower heating element 172 and an upper heating element 176. Although two heating elements are shown in this example, in alternate embodiments more or less than two heating elements can be used. In one embodiment, the lower heating element 172 is positioned adjacent bottom wall 160 and the upper heating element 176 is positioned adjacent top wall 156. The heating elements 172, 176 will generally be referred to herein as bake and broil heating elements, respectively. In alternate embodiments, the heating elements 172, 176 can be arranged in any suitable manner. In an exemplary embodiment, at least one cooking rack 180 for supporting an object 184, such as a cooking or bake pan containing an item to be cooked, is positioned within the oven cavity 144.

At least one of the inner walls 152-160 includes one or more ventilation aperture 188. In one embodiment, the ventilation aperture 188 is fed by a source of ambient air (represented by flow arrows 192) via a duct 196. The ambient air will generally be cooler than the heated air inside the oven cavity 144. The duct 196 is in fluid communication with both the ventilation aperture 188 and a source or supply of ambient air (represented by flow arrow 200) that is external to the oven cavity 144. A fan or blower 204 is in fluid communication with the duct 196 and supply of ambient air 200, and is configured to direct the ambient air 192 to the oven cavity 144 along a side 208 of the object 184, such as a baking pan, for example. In one embodiment, the blower 204 may also be used to cool electronic components inside the control area 122 of the range 100, as will be appreciated by one of skill in the art.

In an exemplary embodiment, the ventilation aperture 188 may be substantially aligned with the rack 180 to direct the ambient air 192 onto and along the sides 208 of the object 184 with a minimum flow of ambient air 192 over and along the top or bottom surfaces. As illustrated in FIG. 2, in one embodiment, the ventilation aperture 188 is disposed at an approximate vertical center of the oven cavity 144. In another embodiment, the location of the aperture 188 is adjustable or movable, in order to accommodate variations of rack 180 positions. In one embodiment, a plurality of ventilation apertures 188 may be provided at a plurality of vertical positions, and include a shutter 210 or other aperture closing device to close those apertures or openings that correspond to unused rack positions.

The ambient airflow 192, as it comes into contact with and cools the sides 208 of object 184, the airflow 192 may absorb heat therefrom and become heated. This heated air is depicted by flow arrow 212 and will generally exit the oven cavity 144 via one or more return openings or return apertures 216 in the inner side walls 152 or top wall 156 of the oven cavity 144, as depicted in FIGS. 2 and 3. Some of the heated airflow 212 may also flow back into and through the duct 196 and be recirculated into the oven cavity 144.

In one embodiment, a fan 214, which is one embodiment is a convection fan, is used to draw air from the duct 196 and direct the air through the ventilation aperture 188 into the oven cavity 144. The convection fan 214 may be used to blend the ambient air 192 and heated air 212 and direct the blend of airflows 192, 212 along the sides 208 of the object 184.

In one embodiment, an amount of ambient airflow 192 to be provided is regulated via a damper 220 that includes an actuator 224 in communication with the controller 140. The controller 140 is responsive to one or more operational parameters to modulate an amount of ambient air 192 to be introduced into the oven cavity 144. For example, in response to a user selection, via the input selector 128, of an "even rise" baking mode, the controller 140 is configured to cause the actuator 224 to open the damper 220, by generating, for example, a damper open signal. The opening of the damper 220 will result in the introduction of ambient airflow 192 into the oven cavity 144. Likewise, in response to the de-selection, via the input selector 120, of the "even rise" baking mode, the controller 140 is configured to cause the actuator 224 to close the damper 220, by generating, for example, a damper closed signal. The closing of the damper 220 will generally prevent the introduction of ambient air 192 into the oven cavity 144. The controller 140 can be configured to generate the damper open signal or a damper closed signal, responsive to user selection of specific modes or functions of the oven 100. The actuator 224 may be a solenoid, a linear motor, a stepper motor, a low velocity motor with a cam, or any other appropriate driving arrangement configured to open and close the damper 220. In one embodiment, a default state of the damper 220 may be in the closed position, and may include a spring 228 to bias the damper 220 to the closed position. The spring 228 may be sized accordingly to withstand over-pressure events within the oven cavity 144 while the damper 220 is in the closed position.

In an embodiment, the controller 140 may be configured to generate a damper position signal, to open (or close) the damper 220 a specific amount, and thus modulate an amount of ambient air 192 to be provided to the oven cavity 144. For example, an appropriate amount of ambient air 192 to cool the sides 208 of the object 184 and yield a desirable final texture of the object 184 may depend upon a variety of operational parameters that may be sensed by, or input to, the controller 140, such as via the input selector 128 for example. These operational parameters which can be sensed or set, can include, but are not limited to, a radiant heat configuration of the oven (referring to the location of the heat source for the oven cavity 144 for the selected mode of operation, e.g., bottom element 172 only, top element 176 only, or both top 176 and bottom 172 elements), a temperature of the food, and a temperature of the air as it blows onto the object 184. Other parameters may include the location of the object 184 within the oven cavity 144, the number of objects 184 within the cavity 144, the color (emissivity) of object or pan 184, a temperature of the air within oven cavity 144, and a temperature of a wall of the oven liner 148.

In an embodiment, the controller 140 may generate a damper position signal to modulate a size of the damper 220 opening. By modulating the size of the damper 220 opening, the controller 140 further modulates an amount of airflow through the damper 220. In a further embodiment, the controller 140 may provide cycling of the damper position 220. For example, the controller 140 may cycle the damper 220 between two or more different damper 220 opening positions. For example, cycling of the damper 220 to be opened for ten seconds and closed for twenty seconds yields approximately one-third of the flow rate that would result if the damper 220 were open for the entire thirty seconds. In one embodiment, this duty cycling behavior can be at set rate, as described above. In another embodiment, the duty cycling can be regulated by one of the operational parameters described above.

In order to entrain cooling ambient air 192 into the oven cavity 144, the cavity 144 must be at a lower pressure than the ambient air 200 surrounding the range 100. In one embodiment, this can be achieved by locating the damper 220 on the exhaust (high-pressure) side of the blower 204. A vent 232 inside the oven cavity 144 is in fluid communication with the external ambient air 200 on the low-pressure side of the blower 204 to prevent pressure build-up in the oven cavity 144. Thus, the amount of cooling ambient air 192 provided to the oven cavity 144 by the blower 204 through damper 220 proportionally displaces heated air through the vent 232.

Figure 5:
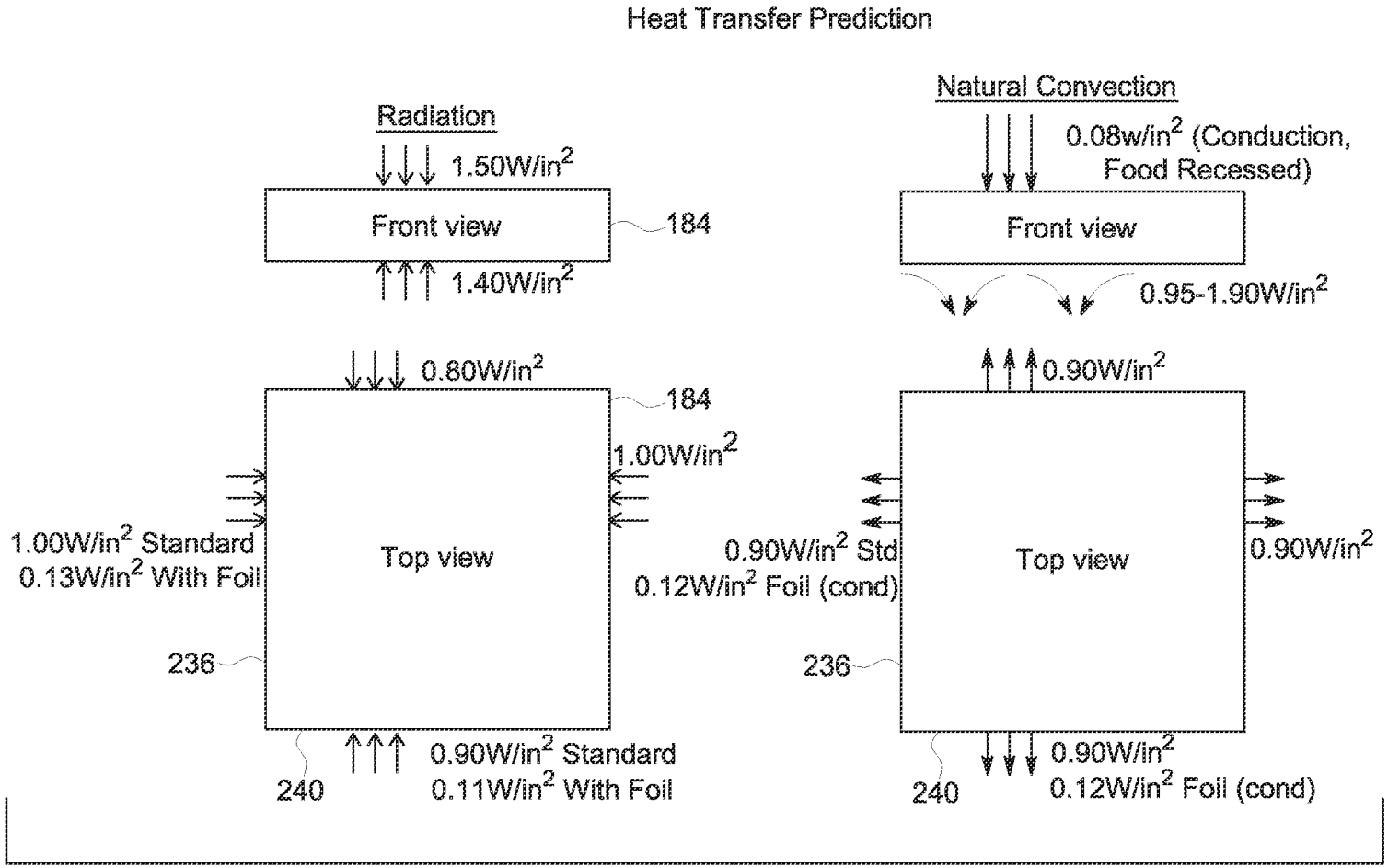
FIG. 5 depicts results of a heat transfer prediction analysis for an oven incorporating aspects of the disclosed embodiments.

FIG. 5 depicts results of a heat transfer prediction analysis for an approximation of an oven 100 incorporating aspects of the disclosed embodiments. An objective of this analysis was to find an analytical and empirical approximation for limiting heat transfer to the sides of a baked good (brownies, in this case) and to prove that such limitation yielded the "even-baking" result desired. In this case, a radiant and convective heat shield of aluminum foil served as an approximation for blowing cool air across the sides of the pan to limit radial food heating. In this embodiment, the object 184 is an 8 inch by 8 inch cooking pan. The oven cavity 144 is heated to approximately 350 degrees Fahrenheit. A foil thermal shield (not shown) is incorporated or positioned on two sides 236, 240 of the pan 184 to reduce radiation and natural convection heat transfer. This analysis simulates the effects of providing ambient cooling air 192 to and along the sides 208 of the pan 184. From FIG. 5, it can be appreciated that addition of the foil shield to the two sides 236, 240, resulted in a reduction of radiation heat transfer from 1.00 Watts per square inch to 0.13 Watts per square inch and a reduction of natural convection heat transfer from 0.90 Watts per square inch to 0.12 Watts per square inch.

Figure 6:
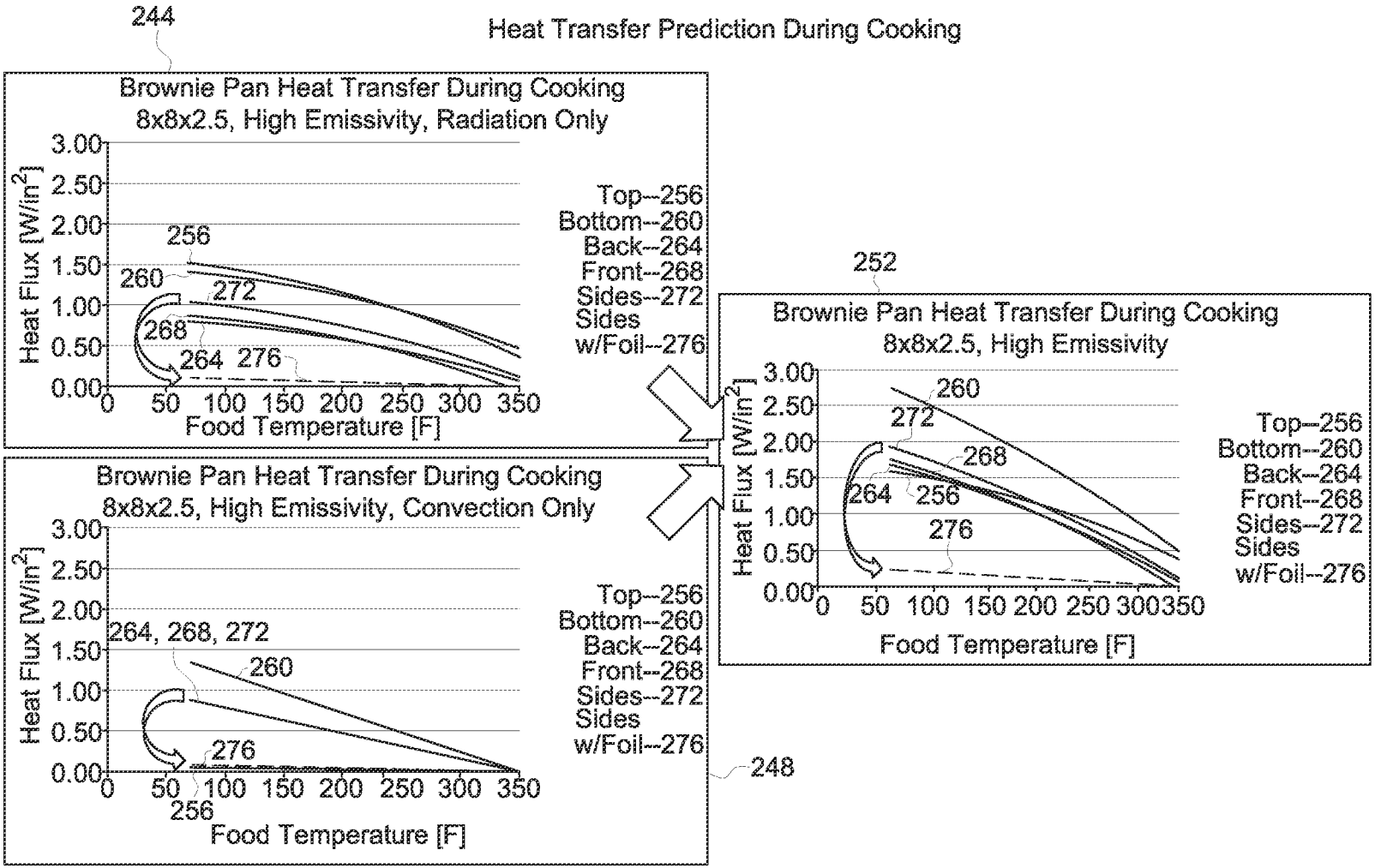
FIG. 6 are graphs illustrating the results of the heat transfer prediction during cooking in an oven incorporating aspects of the disclosed embodiments.

FIG. 6 depicts three graphs illustrating the results shown in FIG. 5. Graph 244 indicates the radiation heat transfer, graph 248 indicates the convective heat transfer, and graph 252 indicates the combined results of graphs 244 and 248. In each graph 244, 248, 252, a function 256, 260, 264, 268, 272 of heat transfer to food temperature is plotted corresponding to the respective top, bottom, back, front, and sides of the pan. Function 276 indicates the heat transfer through the sides of the pan 184 with the foil shield. It can be seen that cooling the sides 208 of the pan 184, as approximated by the foil shield, results in significant reduction of heat transfer. In an empirical baking test, it was found that the edges of baked brownies corresponding to the sides of the pan without foil were approximately 10 millimeters thick with a hard, crunchy texture, while the edge of the brownies corresponding to the sides of the pan with foil were approximately 2 millimeters thick with a firm, but neither hard nor crunchy, texture.

Figure 7:
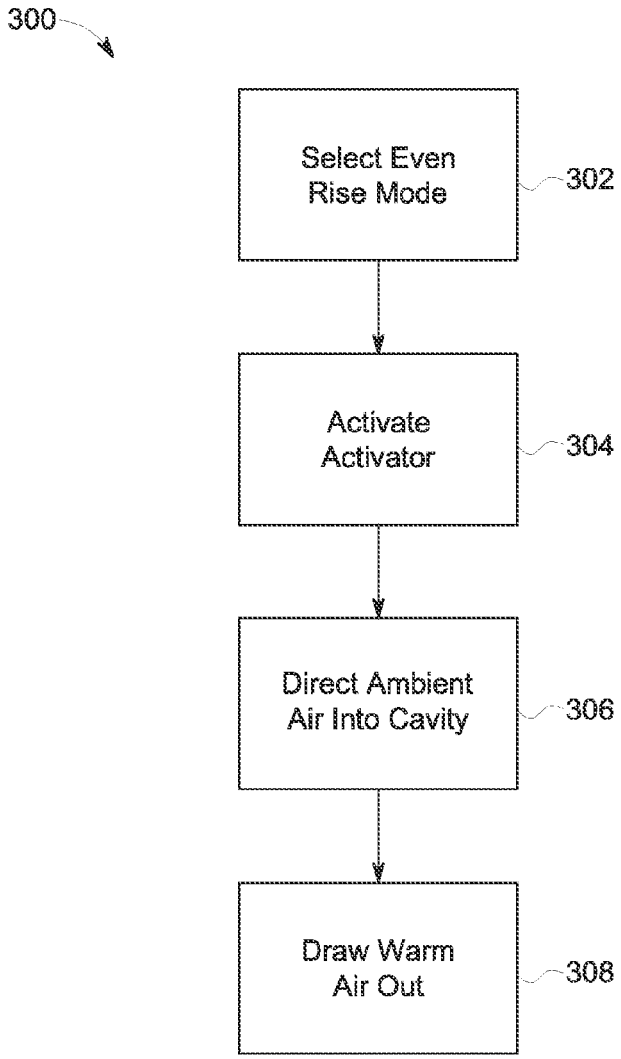
FIG. 7 depicts a flowchart of one embodiment of a process for operating an oven incorporating aspects of the disclosed embodiments.

In view of the foregoing, the range 100 described herein facilitates a method of operating an oven. FIG. 7, with reference to FIGS. 2 through 4, depicts a flowchart 300 of process steps of operating an oven, such as an oven unit 116 of range 100. The method begins at step 302 by detecting selection or actuation of the even rise baking mode. The controller 140 activates 304 the actuator 224 to open the damper 220. Ambient air 192 is directed or forced 306 into the oven cavity 144 through a duct 196 in fluid communication with the ventilation aperture 188. The ambient air 192 effectively cools the sides of the pan 184. The warmed or heated air 212 is drawn 308 out of the oven cavity 144 through the vent 232.

In an embodiment, directing ambient air into the oven cavity 144 includes modulating an amount of the ambient air 192 supplied to the oven cavity 144 by adjusting a position of the damper 220 disposed between the blower 204 and the ventilation aperture 188.

The aspects of the disclosed embodiments are directed to directing a relatively cool airflow across the sides of the object or food being heated in an oven, while still allowing the top and bottom of the food to cook via radiant heat. Ambient room air is entrained into a duct and directed into the oven cavity so it flows along the sides of the item being heated and provides cooling relative to the temperature of the oven cavity 144. This can provide advantages such as an even final texture of pan-baked items with the center and sides of food cooked at the same rate including flat-rising cakes and edge-less brownies, as well as increased operational flexibility.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An oven comprising:

an oven cavity with top, bottom, back and side wall panels, at least one side wall panel comprising a ventilation aperture;

a duct in fluid communication with the ventilation aperture, a first portion of the duct in fluid communication with a supply of ambient air that is external to the oven cavity, and a second portion of the duct in fluid communication with a supply of heated air that is internal to the oven cavity;

a blower in fluid communication with the duct, the blower forcing the supply of ambient air into the first portion of the duct and into the oven cavity via the ventilation aperture;

a damper in fluid communication with the first portion of the duct to control the supply of ambient air into the duct; and a fan in fluid communication with the ventilation aperture configured to draw a combination of the ambient air and heated air in the duct into the oven cavity and provide a cooling airflow into the oven cavity, wherein the ventilation aperture is aligned in the at least one side wall panel of the oven cavity to direct the cooling airflow along lateral sides of an object positioned within the oven cavity to cool the lateral sides of the object at a higher rate than a top and a bottom of the object during cooking.

2. The oven of claim 1, wherein the blower is disposed between the supply of ambient air and the ventilation aperture.

3. The oven of claim 1, comprising a return aperture in the top wall panel of the oven cavity in fluid communication with the second portion of the duct to allow the supply of heated air that is internal to the oven cavity to enter the second portion of the duct.

4. The oven of claim 3, further comprising:

a vent internal to the oven cavity in fluid communication with the ambient air external to the oven cavity, the vent in fluid communication with the return aperture and the second portion of the duct.

5. The oven of claim 4, further comprising:

the damper being disposed on a high pressure side of the blower, and wherein a discharge of the vent is in fluid communication with a low pressure side of the blower to prevent pressure build-up in the oven cavity.

6. The oven of claim 5, further comprising:

a controller configured to receive an operational parameter and generate a damper opening signal; and an actuator in signal communication with the controller, the actuator responsive to the damper opening signal to modulate a position of the damper.

7. The oven of claim 6, wherein the actuator is responsive to the damper opening signal to cycle the damper between two damper positions.

8. The oven of claim 6, wherein the operational parameter comprises at least one of:

a radiant heat configuration of the oven cavity;

a temperature of the object within the oven cavity;

a temperature of air forced into the oven cavity;

a location of the object within the oven cavity;

a number of objects within the oven cavity;

an emissivity of the object within the oven cavity;

a temperature of one of the oven cavity wall panels; and a temperature of the air within the oven cavity.

9. The oven of claim 1, wherein the ventilation aperture is disposed at an approximate vertical center of the at least one side wall panel.

10. The oven of claim 1, wherein a vertical location of the ventilation aperture is adjustable.

11. The oven of claim 1, wherein the ventilation aperture comprises a plurality of ventilation apertures disposed at a plurality of vertical locations.

12. The oven of claim 11, further comprising:

at least one shutter closing at least one of the ventilation apertures.

13. An oven comprising:

an oven cavity with top, bottom, back and side wall panels, at least one wall panel comprising a ventilation aperture;

a duct in fluid communication with the ventilation aperture, a first portion of the duct being in fluid communication with a supply of ambient air external to the oven cavity, and a second portion of the duct being in fluid communication with air internal to the oven cavity;

a blower in fluid communication with the duct, the blower forcing the supply of ambient air into the first portion of the duct and into the oven cavity via the ventilation aperture;

a damper in fluid communication with the first portion of the duct, disposed between the supply of ambient air and the ventilation aperture, the damper configured to modulate an amount of ambient air drawn into the oven cavity; and a circulation fan in communication with the duct and the ventilation aperture and configured to combine the ambient air from the first portion of the duct and the air internal to the oven cavity from the second portion of the duct, and provide a cooling airflow into the oven cavity through the ventilation aperture, wherein the ventilation aperture is aligned in the at least one side wall panel of the oven cavity to direct the cooling airflow along lateral sides of an object positioned within the oven cavity to cool the lateral sides of the object at a higher rate than a top and a bottom of the object during cooking 14. The oven of claim 13, further comprising a return aperture in the top wall panel of the oven cavity, the return aperture in fluid communication with the second portion of the duct.

15. The oven of claim 14, further comprising a vent internal to the oven cavity and in fluid communication with the supply of ambient air external to the oven cavity, the vent in fluid communication with the return aperture via the second portion of the duct; wherein the damper is disposed on a high pressure side of the blower, and a discharge of the vent is in fluid communication with a low pressure side of the blower to prevent pressure build-up in the oven cavity.

16. The oven of claim 13, further comprising:

a controller configured to receive an operational parameter and generate a damper opening signal; and an actuator in signal communication with the controller, the actuator responsive to the damper opening signal to modulate a position of the damper.

17. The oven of claim 13, wherein the ventilation aperture is disposed at an approximate vertical center of the at least one side wall panel.

18. The oven of claim 13, wherein a vertical location of the ventilation aperture is adjustable.

19. The oven of claim 13, wherein the ventilation aperture comprises a plurality of ventilation apertures disposed at a plurality of vertical locations, the oven further comprising:

at least one shutter closing at least one of the ventilation apertures.

20. A method of operating an oven, the method comprising:

providing an oven cavity with top, bottom, back and side wall panels, at least one side wall panel comprising a ventilation aperture;

detecting a selection of an operating of the oven;

activating an actuator to open a damper in fluid communication with the ventilation aperture;

forcing a flow of cooling ambient air into the oven cavity through a duct in a side wall panel that is in fluid communication with the damper, the cooling ambient air being supplied from an environment external to the oven cavity;

directing the cooling ambient air from the ventilation aperture along lateral sides of an object within the oven cavity to cool the lateral sides of the object at a higher rate than a top and a bottom of the object during cooking; and ventilating air internal to the oven cavity through a return aperture in the top wall panel of the oven cavity to the duct.

21. The method of claim 20, comprising modulating an amount of ambient air forced into the oven cavity.

22. The method of claim 21, wherein the modulating comprises adjusting the damper disposed between a blower and the ventilation aperture.

* * * * *